US008707733B2

(12) United States Patent
Weingarten

(10) Patent No.: US 8,707,733 B2
(45) Date of Patent: Apr. 29, 2014

(54) CUT GEMSTONE PROVIDING A SPECIFIC OPTICAL PATTERN

(76) Inventor: Jonathan Weingarten, Wantagh, NY (US)

( * ) Notice: Subject to any disclaimer, the term of this patent is extended or adjusted under 35 U.S.C. 154(b) by 282 days.

(21) Appl. No.: 12/797,001

(22) Filed: Jun. 9, 2010

(65) Prior Publication Data

US 2011/0302960 A1 Dec. 15, 2011

(51) Int. Cl.
*A44C 17/00* (2006.01)

(52) U.S. Cl.
USPC ..... 63/32

(58) Field of Classification Search
None
See application file for complete search history.

(56) References Cited

U.S. PATENT DOCUMENTS 5,970,744 A * 10/1999 Greeff ..... 63/32
D499,662 S * 12/2004 Lax ..... D11/90
2011/0265514 A1* 11/2011 Fakier ..... 63/12

OTHER PUBLICATIONS

"The Hope Diamond", made in 1910, Smithsoniam webpage http://mineralsciences.si.edu/research/gems/hope_diamond/blue_diamond_research.htm.*

* cited by examiner

*Primary Examiner* — Jack W. Lavinder
(74) *Attorney, Agent, or Firm* — Yuri Astvatsaturov

(57) ABSTRACT

A gemstone cut with a table facet, where the gemstone receives existing light from around the viewer and the facets on the bottom of the diamond effectively reflect the existing light back into the eyes of the beholder in such a manner as to maximize light performance, and to produce a unique and distinct look of light in the form of a Maltese cross under the table facet which can be observed in natural ambient light.

11 Claims, 10 Drawing Sheets

Top View

Bottom View

Top View

Bottom View

Top View

Bottom View

CUT GEMSTONE PROVIDING A SPECIFIC OPTICAL PATTERN

FIELD OF THE INVENTION

The invention relates to gemstones, preferably diamonds, that have a cut or shape that causes light entering the gemstone to exit in a specific optical pattern. In particular the present invention relates to diamonds where the light exiting through the table facet provides a pattern in the shape of a Maltese Cross.

BACKGROUND OF THE INVENTION

One of the values of gemstones, is in their appearance. The appearance of the gemstone can often be enhanced by cutting the gemstone into different shapes, and polishing the surface of the gemstone. This is especially true with gemstones that at least pass some light through them, especially diamonds. Depending on the angle that the light strikes the surface and the material of the gemstone, the light can neither be reflected from the surface or pass through the surface. If the light passes into the gemstone, it passes through the gemstone until it reaches another surface. At this other surface, the light in the gemstone can either be reflected back into the gemstone or pass out of the gemstone.

It is often desirable to shape the gemstone so that the light entering one area of the gemstone is redirected by the gemstone to exit from another area. In particular it is often desirable to maximize the light exiting one area, since this gives the gemstone a brilliance or sparkle. Many different gemstone cuts are known, particularly for diamonds, to try to maximize the amount of light that exits one particular area of the gemstone.

One of the most popular cuts for a diamond is known as the "brilliant", which arranges the individual flat surfaces or facets to maximize the light passing out through the main table facet. The "brilliant" cut has a crown portion, a girdle portion and a pavilion portion. Each of these portions has a plurality of facets, especially the crown portion and pavilion portion. The arrangement of these facets is well known to a person of ordinary skill in the art of the present invention, and therefore no further description of the arrangement of facets in the "brilliant" cut is necessary or warranted.

There are many variations of the "brilliant" cut style. Very often the angle of the facets is changed slightly to account for the original shape of the rough diamond, to increase the yield from the rough diamond, or personal preferences. Sometimes the shapes of the facets are changed to provide a finish diamond with a square or rectangular shape. Even with these variations, the cuts still follow the well-known "brilliant" style.

There are many other antique facet designs, such as the "Old Mine Cut". The arrangement of the facets in these antique designs are well known to a person of ordinary skill in the art of the present invention, and therefore no further description of the arrangement of facets in these antique facet designs is necessary or warranted.

SUMMARY OF THE INVENTION

It is an object of the present invention to provide a gemstone cut with a table facet, where the gemstone receives existing light from around the viewer and for the facets on the bottom of the diamond to effectively reflect the existing light back into the eyes of the beholder in such a manner as to maximize light performance, and to produce a unique and distinct look of light in the form of a Maltese cross under the table facet which can be observed in natural ambient light.

The present invention accomplishes this object in a polygonal gemstone with a girdle portion having corners and a girdle plane. A crown portion extends from one side of the girdle portion, and includes a table facet with a plurality of crown facets arranged around the table facet. A pavilion portion extends from another side of the girdle portion diametrically opposite the crown portion, and includes a plurality of pavilion facets tapering the pavilion portion together as the pavilion portion extends away from the girdle. The facets are in an arrangement or a facet structure that follows that of the antique facet design, the "Old Mine Cut" or the brilliant facet style, and where the angles of the facets have been proportioned in such a manner as to provide the above described Maltese cross effect under the table facet.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
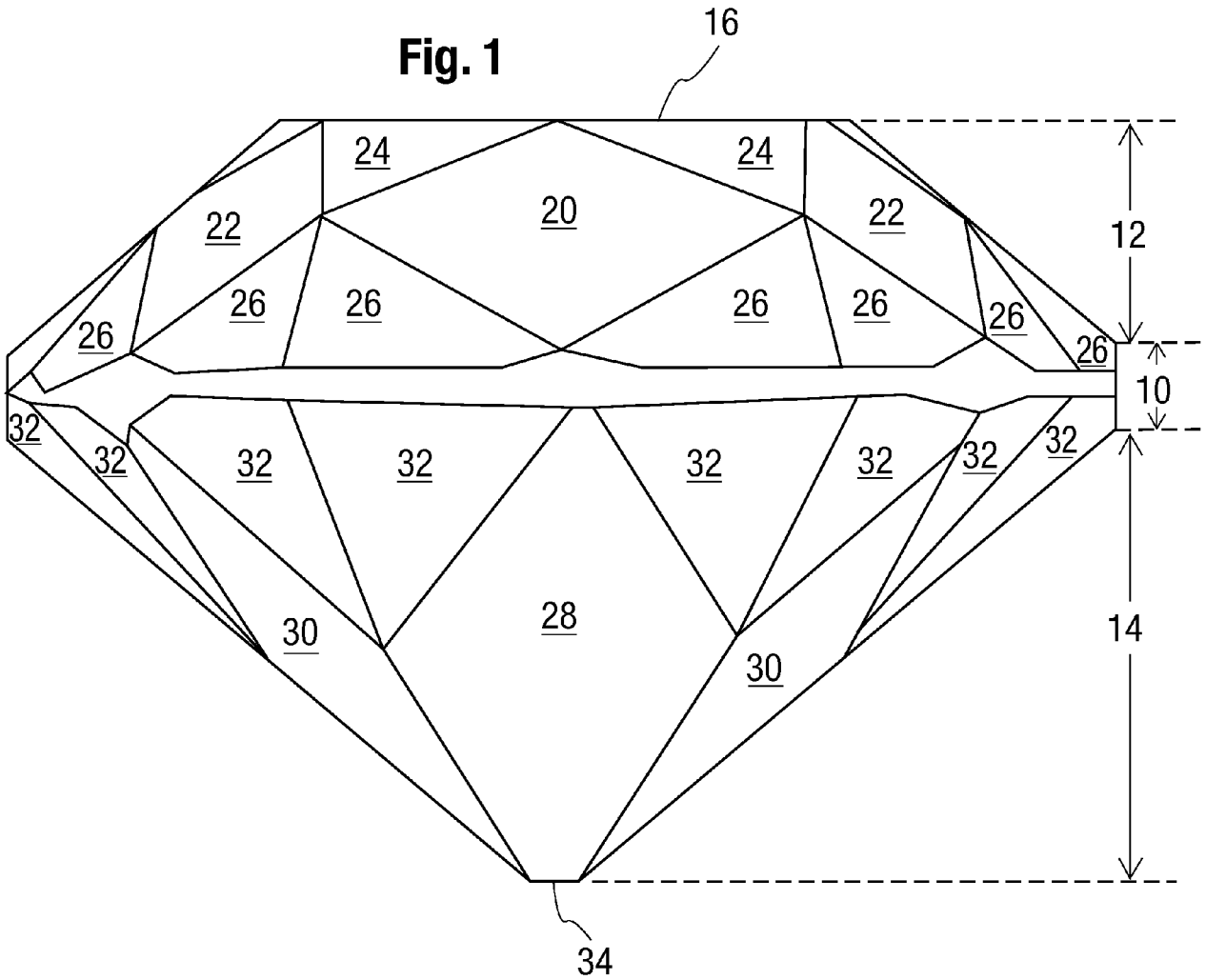
FIG. 1 is a side view of an embodiment of the gemstone cut.
Figure 2:
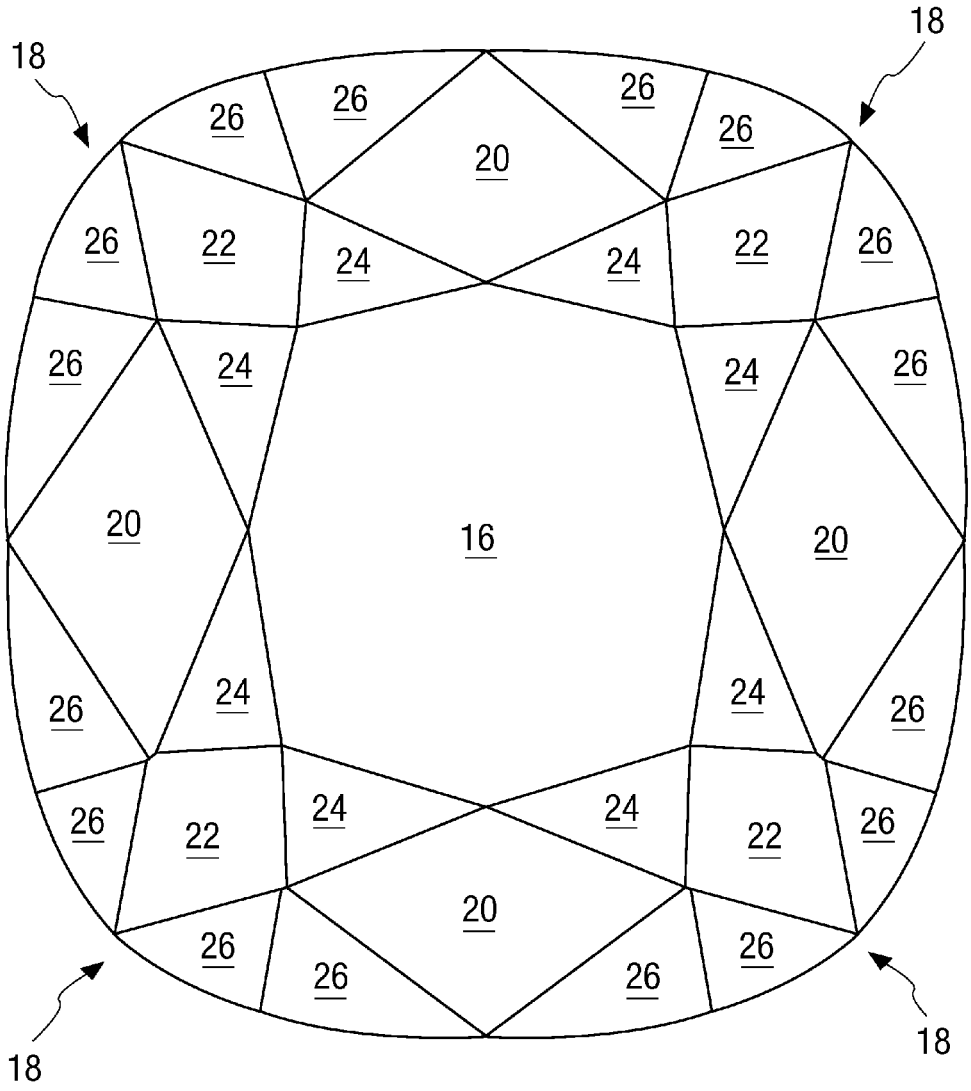
FIG. 2 is a top view of the gemstone cut.
Figure 3:
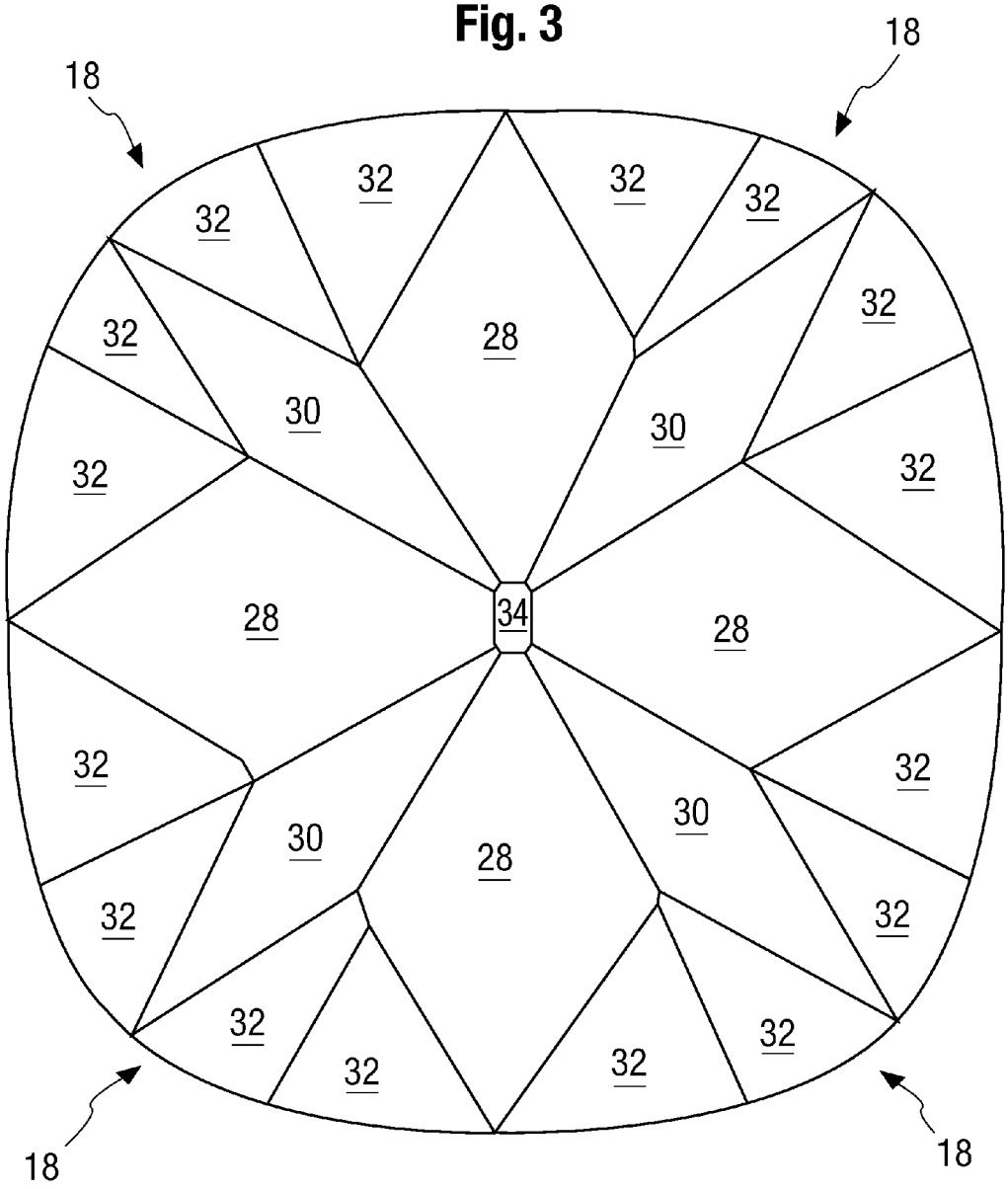
FIG. 3 is a bottom view of the gemstone cut.

Referring to the drawings in particular, FIG. 1 shows a side view of a gemstone, not necessarily drawn to scale. The gemstone has a girdle portion 10 in a square or rectangular shape and having rounded corners 18, FIG. 2. The length to width ratios for rectangular stones are preferably less than 1.10:1. A crown portion 12 extends from one side of the girdle portion 10, and a pavilion portion 14 extends from another side of the girdle portion 10. The crown portion 12 and pavilion portion 14 are on diametrically opposite sides of the girdle portion 10. The crown portion 12 and the pavilion portion 14 have a plurality of facets. The girdle portion 10 can optionally be smooth or faceted.

The crown facets include, a table facet 16, four crown main facets 20, and four crown corner facets 22. Each of the four crown corner facets 22 is arranged in the area of one of the four rounded corners 18 of the girdle portion 10. The crown main facets 20 and crown corner facets 22 are alternately arranged around the table facet 16 with each of the crown main facets 20 being arranged between two of the crown corner facets 22.

The crown facets also include eight crown star facets 24 arranged between the table facet 16, the crown main facets 20, and the crown corner facets 22. One of these crown star facets 24 is arranged between, and is adjacent, each adjacent pair of corner crown facets 22 and corner main facets 20. Each crown star facet 24 is also adjacent to one edge of the table facet 16.

The crown facets also include sixteen crown half facets or crown girdle facets 26 arranged around the table facet 16 and directly adjacent to the girdle portion 10. Two of these crown half facets 26 are arranged between each adjacent pair of crown corner facets 22 and crown main facets 20. Each of these crown half facets 26 is also directly adjacent to either a crown main facet 20 or a crown corner facet 22.

The pavilion facets include four pavilion main facets 28 and four pavilion corner facets 30. Each of the four pavilion corner facets 30 is arranged in the area of one of the four rounded corners 18 of the girdle portion 10. The pavilion main facets 28 and pavilion corner facets 30 are alternately arranged around the pavilion portion 14 with each of the pavilion main facets 28 being arranged between two of the pavilion corner facets 30.

The pavilion facets also include sixteen pavilion half facets or pavilion girdle facets 32 arranged around the pavilion portion 14 and directly adjacent to the girdle portion 10. Two of these pavilion half facets 32 are arranged between each adjacent pair of pavilion main facets 28 and pavilion corner facets 30. Each of these pavilion half facets 32 is also directly adjacent to either a pavilion main facet 28 or a pavilion corner facet 30. The pavilion portion 14 can also have a culet 34.

Figure 4:
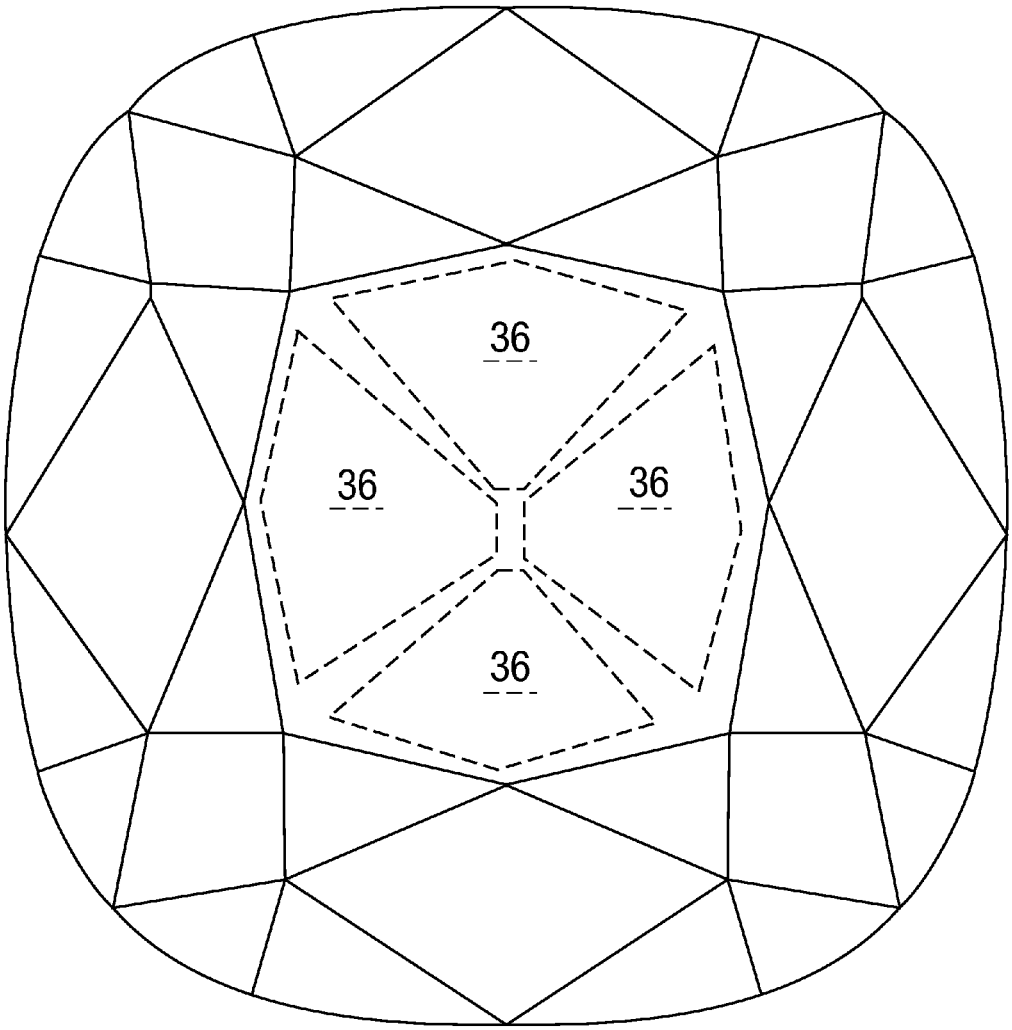
FIG. 4 is a top view of the gemstone cut showing the Maltese cross pattern in a schematic view.
Figure 7:
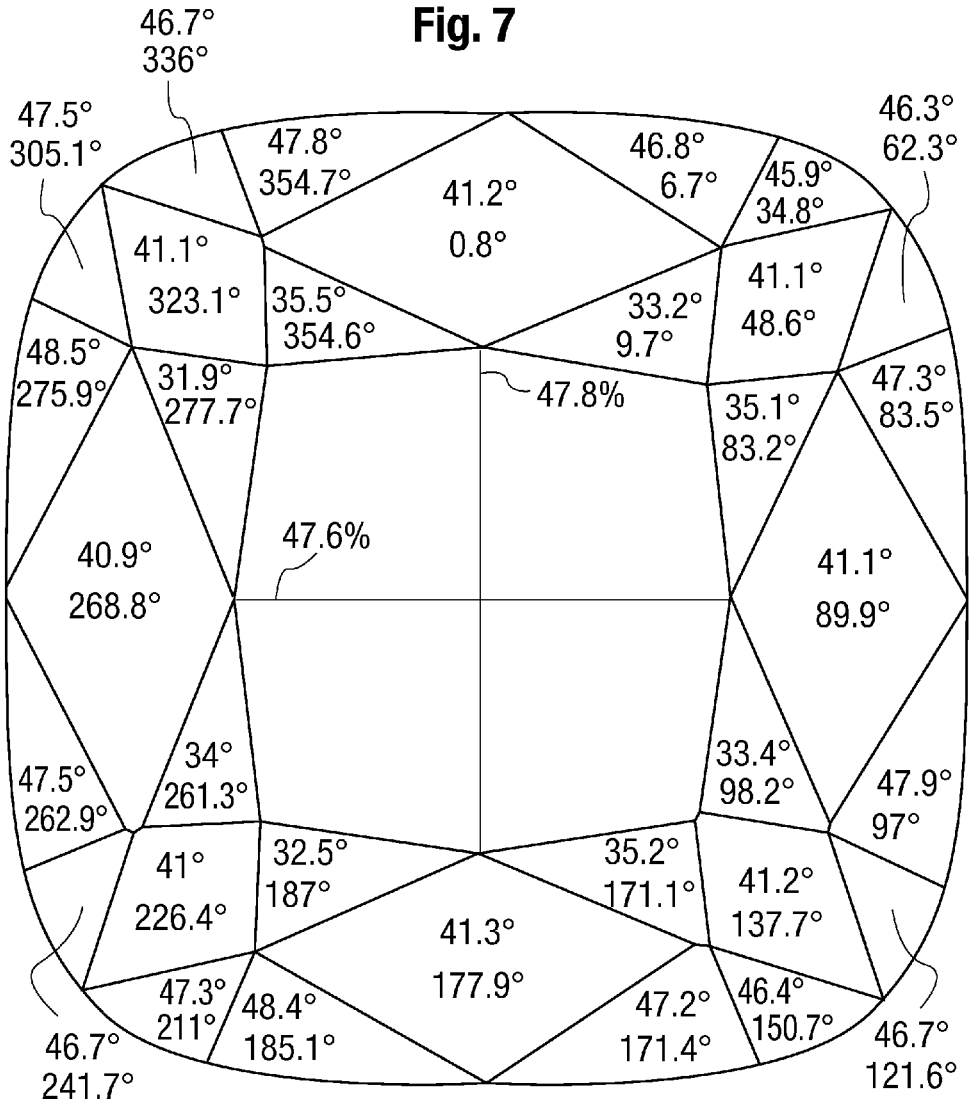
FIGS. 7 and 8 are top and bottom views respectively of another embodiment of the present invention.
Figure 8:
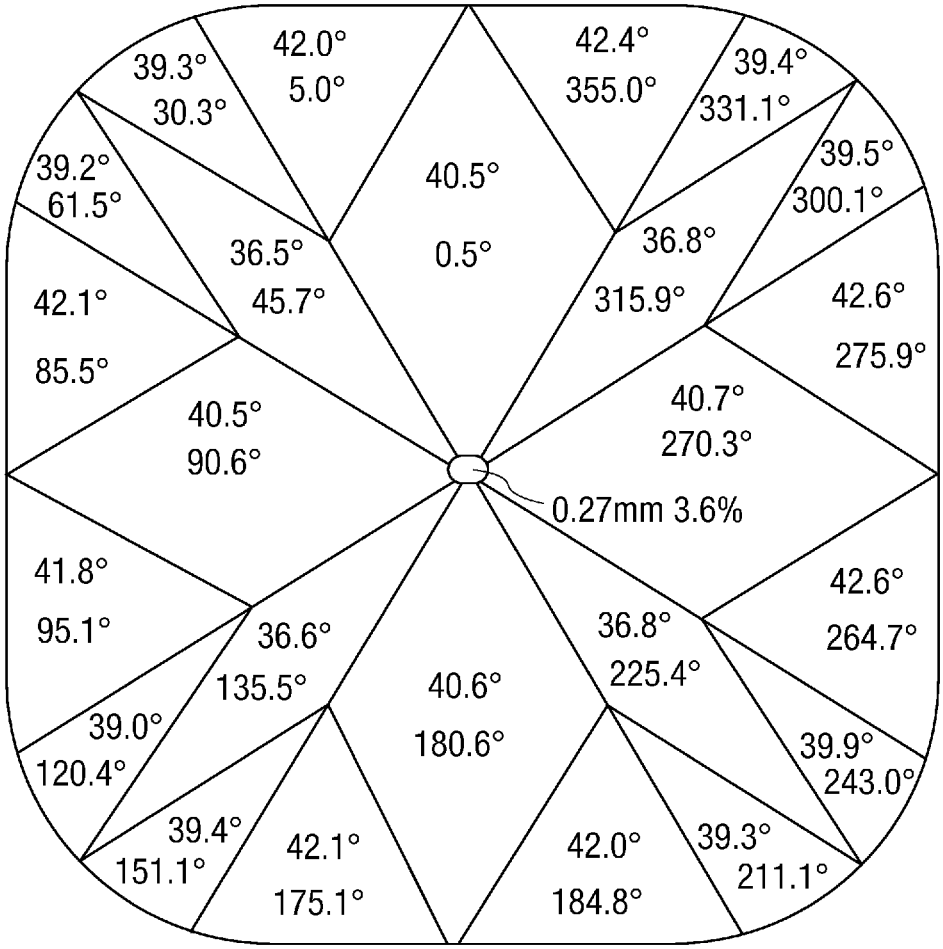
Figure 9:
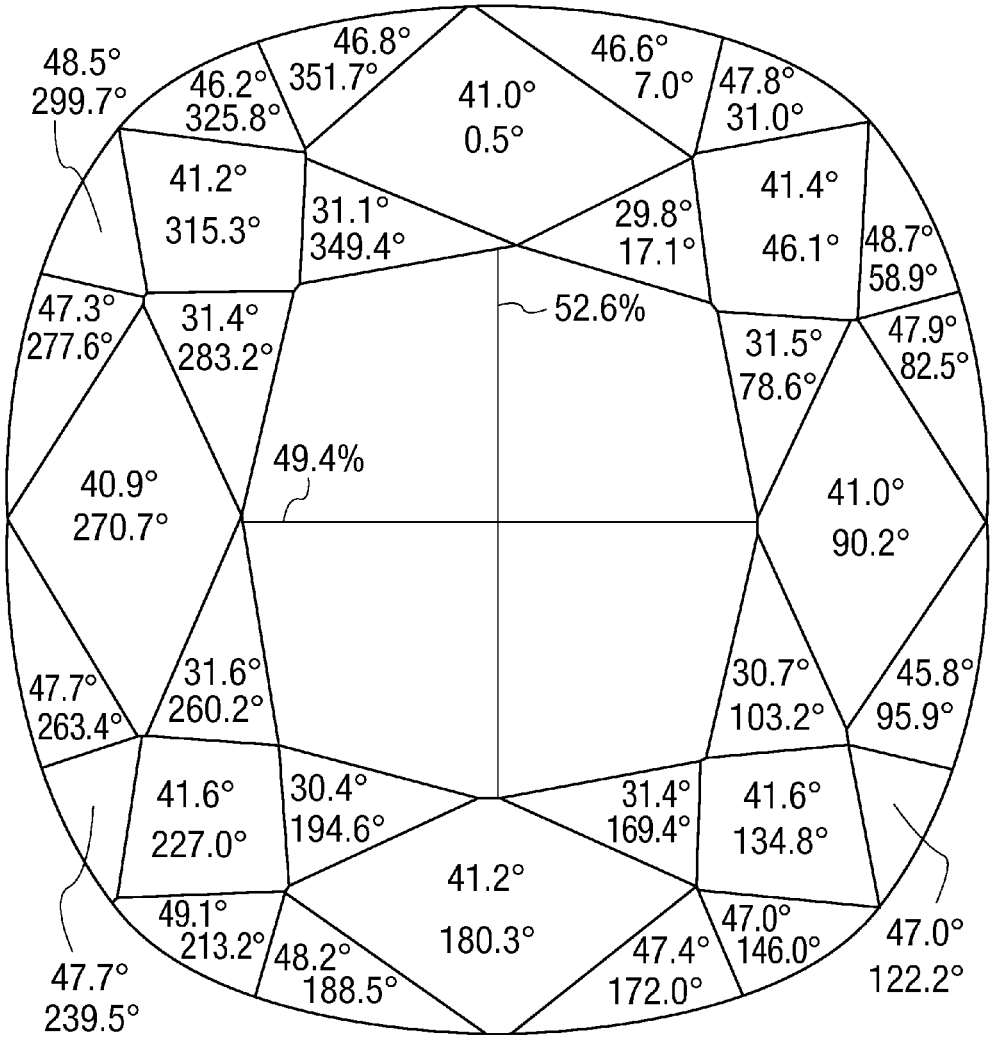
FIGS. 9 and 10 are top and bottom views respectively of still another embodiment of the present invention.
Figure 10:
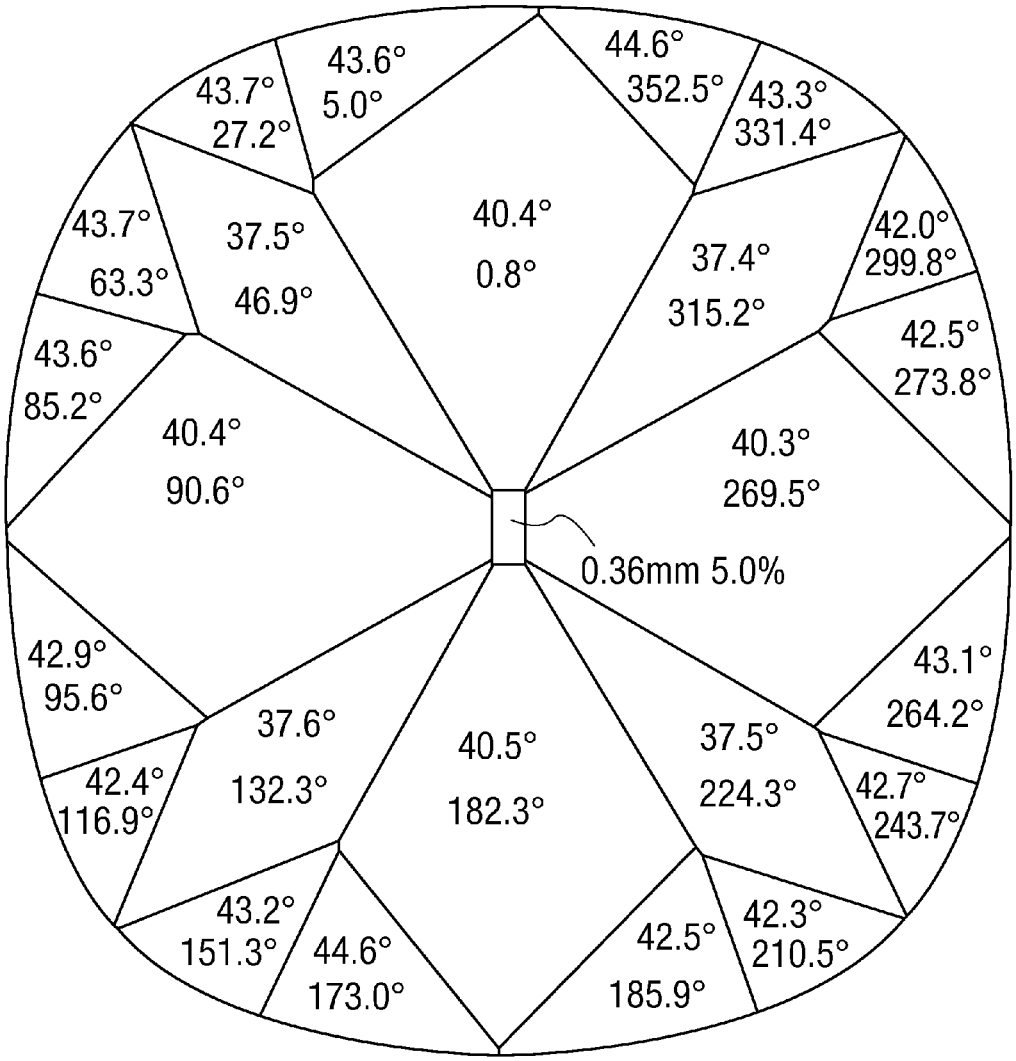

In order to produce the optical pattern of a Maltese cross 36, as shown in FIG. 4, under the table facet 16, the crown and pavilion facets are arranged in specific angular ranges with respect to a plane of the girdle portion 10. These angles depend on the refractive index of the gemstone. For a diamond gemstone, the facets would be preferably arranged in the following ranges:

| | |
|---|---|
| crown main facets 20 | 38-42 degrees |
| crown corner facets 22 | 37-42 degrees |
| crown star facets 24 | 28-35.5 degrees (FIG. 7 for example of upper limit) |
| crown half facets 26 | 47-52.1 degrees (FIG. 5 for example of upper limit) |
| pavilion main facets 28 | 40-41 degrees, preferably 40.4-40.9 degrees |
| pavilion corner facets 30 | 37-40 degrees |
| pavilion half facets 32 | 42-45 degrees. |

To further produce the optical pattern of a Maltese cross, it is preferable for the table facet to be 48-52% of the width of the diamond, the lower half facet length to be 50%+/−5% with respect to length from the edge of the girdle to the cullet, and the star facet/upper half facet ratio to be 45%-55% (+/−5%) with respect to table edge-to-girdle length.

The pavilion facets on the bottom of a diamond will function as either mirrors (reflectors of light, good) or windows (leakers of light, bad). An important step in the optical design is ensuring that the pavilion (bottom facets) are effectively reflecting light back to the viewer. Another important step in the optical design is ensuring that the crown of the diamond draws in its reflections from the brightest resources in the environment. The present invention is designed for the majority of its reflections from the 45-75° angular spectrum.

Figure 5:
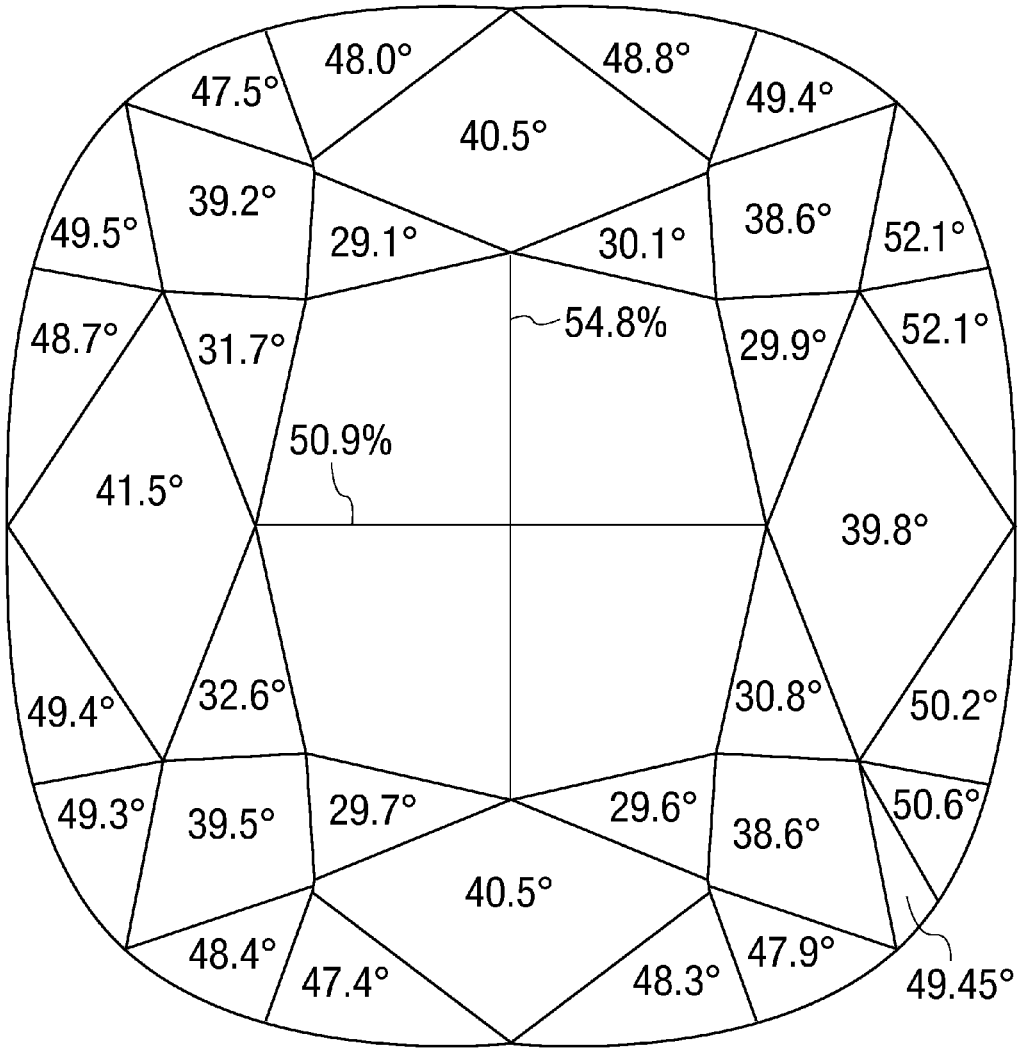
FIGS. 5 and 6 are top and bottom views respectively of one embodiment of the present invention.
Figure 6:
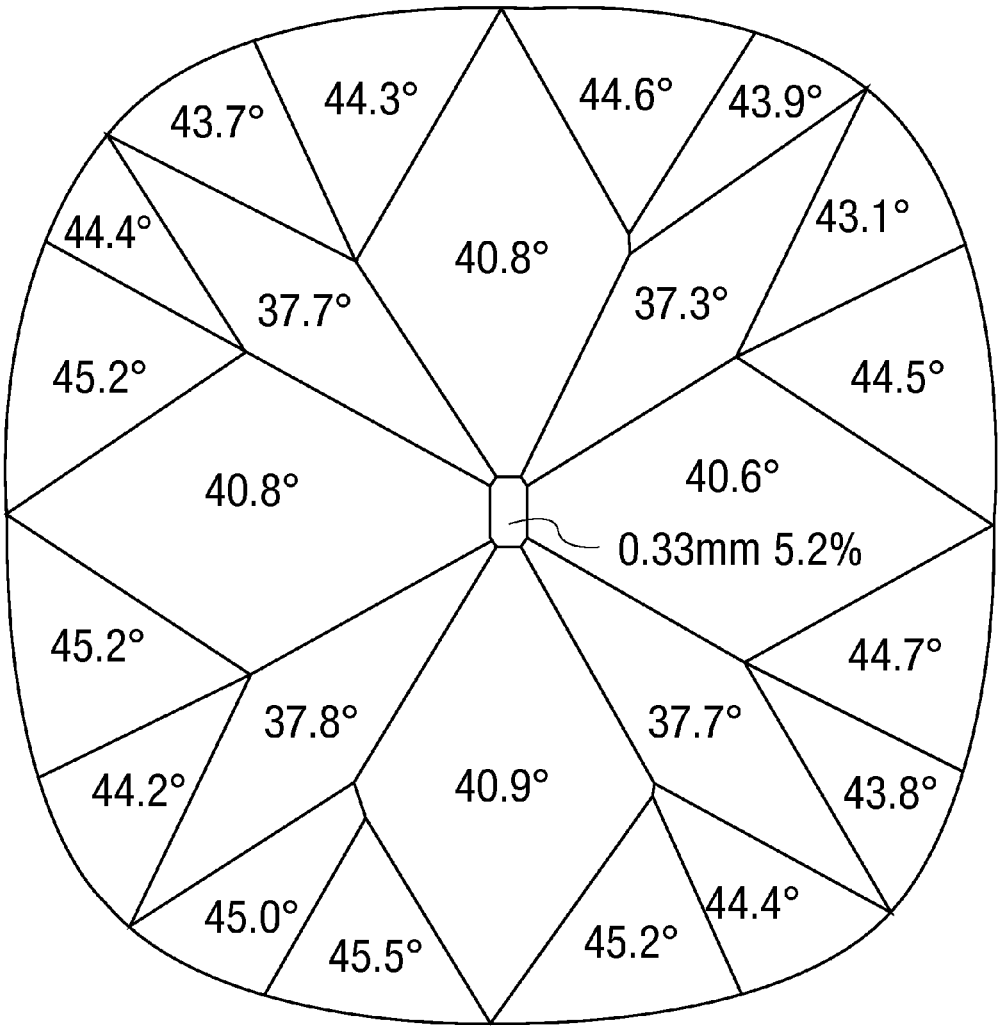

Several of the preferred embodiments of the gemstone in diamond are shown in FIGS. 5 & 6, 7 & 8, and 9 & 10. In FIGS. 5 and 6, the slope angles are shown for each facet. In FIGS. 7 through 10, the top angular measurement shown in each facet is the slope angle, and the bottom angular measurement is the index angle. The index angle shows the position of the facet around the stone. These actual angles can vary by approximately plus or minus one degree in these embodiments. The dimensions of the table facet and the culet are also shown. All of the facets in each type of facet can either have the same slope angle, or a slightly different slope angle as shown in the drawings.

An example of a gemstone cut according to the present invention is shown in the appendix.

The gemstone cut shape of the present invention is not limited to only the above described facets. Additional facets can be included, especially to complete an enclosed volume.

While specific embodiments of the invention have been shown and described in detail to illustrate the application of the principles of the invention, it will be understood that the invention may be embodied otherwise without departing from such principles.

What is claimed is:

1. A cut gemstone having a plurality of facets, said gemstone comprising:

a girdle portion having four sides and four corners, said girdle portion having a girdle plane;

a crown portion on one side of said girdle portion, said crown portion including:

a table facet, four crown main facets arranged around said table facet and arranged at an angle between 38-42 degrees with respect to said girdle plane, each of said four crown main facets extending from said table facet to said girdle portion, four crown corner facets arranged around said table facet and arranged at an angle between 37-42 degrees with respect to said girdle plane, each of said four crown corner facets extending from said table facet to said girdle portion, eight crown star facets arranged around said table facet and arranged at an angle between 28-35.5 degrees with respect to said girdle plane, and sixteen crown half facets arranged around said table facet and arranged at an angle between 47-52.1 degrees with respect to said girdle plane; and a pavilion portion arranged on another side of said girdle portion diametrically opposite said crown portion, said pavilion portion tapering inward to a tip as it extends away from said girdle plane, said pavilion portion including:

four pavilion main facets arranged at an angle between 40-41 degrees with respect to said girdle plane, each of said four pavilion main facets extending from said girdle portion to said tip, four pavilion corner facets arranged at an angle between 36.5-40 degrees with respect to said girdle plane, each of said four pavilion corner facets extending from said girdle portion to said tip, and sixteen pavilion half facets arranged at an angle between 39-45 degrees with respect to said girdle plane.

2. The cut gemstone of claim 1, wherein said gemstone is a diamond.

3. The cut gemstone of claim 1, wherein said table facet is substantially parallel with said girdle plane, wherein each of said four crown main facets is arranged between said table facet and one of said four sides of said girdle portion, wherein each of said four crown corner facets is arranged between said table facet and one of said four corners of said girdle portion, wherein said four crown main facets and said four crown corner facets are alternately arranged around said table facet with each of said four crown main facets being arranged between two of said four crown corner facets, wherein each of said eight crown star facets is arranged directly adjacent to said table facet and is arranged between said table facet, one of said four crown main facets, and one of said four crown corner facets, wherein each of said sixteen crown half facets is arranged directly adjacent to said girdle portion and directly adjacent to one of said four crown main facets or one of said four crown corner facets, wherein said pavilion portion tapers inward towards a culet as said pavilion portion extends away from said girdle plane, wherein each of said four pavilion main facets is arranged between said culet and one of said four sides of said girdle portion, wherein each of said four pavilion corner facets is arranged between said culet and one of said four corners of said girdle portion, wherein said four pavilion main facets and said four pavilion corner facets are alternately arranged with each of said four pavilion main facets being arranged between two of said four pavilion corner facets, and wherein each of said sixteen pavilion half facets is arranged directly adjacent to said girdle portion and directly adjacent to one of said four pavilion main facets or one of said four pavilion corner facets.

4. The cut gemstone of claim 1, wherein said girdle portion has a width, and wherein said table facet has a width that is 48-52% of said width of said girdle portion.

5. The cut gemstone of claim 1, wherein said corners of said girdle portion are rounded.

6. The cut gemstone of claim 1, wherein said corners of said girdle portion are substantially 90° corners.

7. The cut gemstone of claim 1, wherein said four pavilion main facets are arranged at an angle between 40.4-40.9 degrees with respect to said girdle plane.

8. The cut gemstone of claim 1, wherein at least one additional facet is included on at least one of said crown portion and said pavilion portion.

9. The cut gemstone of claim 1, wherein said girdle portion is one of squarely shaped or rectangularly shaped, said rectangular shape having a length-to-width ratio of less than 1.1 to 1.

10. The cut gemstone of claim 1, wherein at least one of said four crown main facets has a substantially quadrilateral shape, wherein at least one of said four crown corner facets has a substantially quadrilateral shape, wherein at least one of said eight crown star facets has a substantially triangular shape, wherein at least one of said sixteen crown half facets has a substantially triangular shape, wherein at least one of said four pavilion main facets has one of a substantially quadrilateral shape or a substantially pentagonal shape, wherein at least one of said four pavilion corner facets has a substantially quadrilateral shape, wherein at least one of said sixteen pavilion half facets has a substantially triangular shape, and wherein said crown facets and said pavilion facets are arranged to provide an optical pattern of a Maltese cross under said table facet when observed in natural ambient light and viewed through said table facet.

11. The cut gemstone of claim 1, wherein said tip forms a culet.

* * * * *